US011280105B2

(12) United States Patent
Bishop, III et al.

(10) Patent No.: US 11,280,105 B2
(45) Date of Patent: Mar. 22, 2022

(54) PREFABRICATED CONCRETE POLE BASE AND METHOD OF INSTALLATION

(71) Applicant: Valmont Industries, Inc., Omaha, NE (US)

(72) Inventors: Jackson D Bishop, III, Castle Rock, CO (US); Andrew Burke, Littleton, CO (US)

(73) Assignee: Valmont Industries, Inc., Omaha, NE (US)

( * ) Notice: Subject to any disclaimer, the term of this patent is extended or adjusted under 35 U.S.C. 154(b) by 0 days.

(21) Appl. No.: 15/866,224

(22) Filed: Jan. 9, 2018

(65) Prior Publication Data

US 2018/0195305 A1 Jul. 12, 2018

Related U.S. Application Data

(60) Provisional application No. 62/444,213, filed on Jan. 9, 2017.

(51) Int. Cl.
*E04H 12/22* (2006.01)
*E02D 27/42* (2006.01)

(52) U.S. Cl.
CPC ..... *E04H 12/2269* (2013.01); *E02D 27/42* (2013.01)

(58) Field of Classification Search
CPC . E04H 12/2269; E04H 12/2276; E04H 12/22; E04H 12/2253; E04H 12/2261; E04H 12/2284; E04H 12/2292; E04H 12/347; E02D 27/42; E01F 9/685
USPC ..... 248/530; 52/297, 298; 403/369; 174/45 R, 37–38, 490, 503, 559, 563
See application file for complete search history.

(56) References Cited

U.S. PATENT DOCUMENTS 239,080 A * 3/1881 Baker ..... E04H 12/2269 52/298
432,043 A * 7/1890 Heiland ..... E04H 12/2276 52/297
595,217 A * 12/1897 Speyer ..... E04H 12/2276 52/297
994,742 A * 6/1911 Gregory ..... E04H 12/2276 256/19
1,611,935 A 12/1926 Mitchell
1,799,314 A 4/1931 Pfaff
2,236,775 A * 4/1941 Hunsaker ..... H02B 1/00 52/294
2,374,624 A * 4/1945 Schwendt ..... E02D 27/01 52/169.9

(Continued)

OTHER PUBLICATIONS

"Mounting dish in a bucket of concrete?," Satellite Guys, Dec. 3, 2004, retrieved from https://www.satelliteguys.us/xen/threads/mounting-dish-in-a-bucket-of-concrete.20219, 3 pages.

(Continued)

*Primary Examiner* — Ingrid M Weinhold
(74) *Attorney, Agent, or Firm* — Milligan PC LLO

(57) ABSTRACT

A pole base for supporting light poles and the like is provided. In some embodiments, a compression connection is provided to secure a pole in a fixed, stable, and upright position. Pole bases of the present disclosure comprise a recessed pole insertion well and a central pole registration hub, electrical conduit raceways, temporary pole positioning and stabilizing hardware, and pole stabilizing material.

3 Claims, 9 Drawing Sheets

(56) References Cited

U.S. PATENT DOCUMENTS 2,784,015 A * 3/1957 Swanson ..... E04H 12/2269 403/361
3,305,990 A * 2/1967 Halvard ..... E04H 12/22 248/346.01
3,579,936 A * 5/1971 Andersson ..... E04H 12/2284 403/369
3,988,870 A * 11/1976 Snavely ..... E02D 27/42 52/296
4,059,934 A * 11/1977 Hayamizu ..... A63B 71/028 52/297
4,133,154 A * 1/1979 Ruzicka ..... E02D 27/42 52/100
5,400,997 A * 3/1995 Payne ..... E01F 9/638 248/201
5,689,927 A * 11/1997 Knight, Sr. ..... E01F 8/0023 181/210
5,746,036 A * 5/1998 Angelette ..... E02D 27/42 249/163
7,694,487 B1 * 4/2010 Ryan ..... E02D 27/42 52/741.15
7,765,770 B2 8/2010 Fournier
7,779,588 B1 * 8/2010 Bruning ..... E02D 27/42 52/169.13
7,779,589 B2 * 8/2010 Salman ..... E04B 1/4114 248/156
7,824,082 B2 * 11/2010 Hanson ..... E04H 12/2215 362/382
7,954,289 B2 6/2011 Evans
8,782,978 B1 * 7/2014 Frenette ..... E04H 12/2269 248/519
8,806,821 B1 * 8/2014 Brown ..... E02D 27/42 264/233
8,966,837 B2 3/2015 Knudsen
9,777,456 B1 10/2017 Spiro
10,180,011 B2 * 1/2019 White ..... E04H 12/2215
2003/0121223 A1 * 7/2003 Riker ..... E04H 12/2269 52/296
2005/0051695 A1 3/2005 Kovach
2006/0104715 A1 * 5/2006 Newton ..... E04H 12/2269 404/9
2007/0029459 A1 * 2/2007 Hanson ..... E04H 12/2253 248/530
2015/0113893 A1 * 4/2015 Patterson ..... E04H 12/2269 52/297
2015/0128507 A1 * 5/2015 Knudsen ..... E04H 12/2269 52/105
2016/0281383 A1 * 9/2016 Fujita ..... F16B 13/126
2017/0284120 A1 * 10/2017 White ..... E04H 12/2215

OTHER PUBLICATIONS

"How to Install a Temporary Mail Box Without a Post Hole Digger," WikiHow, Nov. 25, 2006, retrieved from https://web.archive.org/web/20070120094657/http://www.wikihow.com/Install-a-Temporary-Mail-Box-Without-a-Post-Hole-Digger, 1 page.

* cited by examiner

Bottom Surface View
(Top Down View)

Top Surface View
(Bottom Up View)

PREFABRICATED CONCRETE POLE BASE AND METHOD OF INSTALLATION

This U.S. Non-Provisional Patent Application claims the benefit of priority from U.S. Provisional Patent Application 62/444,213, filed Jan. 9, 2017, the entire disclosure of which is hereby incorporated by reference.

FIELD

Embodiments of the present disclosure generally relate to the field of pole supports. More specifically, certain embodiments of the present disclosure relate to precast concrete pole supports or bases and methods of manufacture, installation and use of the same.

BACKGROUND

Pole bases and supports are known and useful for supporting a wide range of items including lighting poles, communications poles, electrical and utility poles, flag poles, and numerous other poles and similar structures. Some of these structures are installed by placing a portion of a lower end of a pole in a hole in the ground and filling the remaining space in the hole with soil. It is known to install wooden posts and poles, for example, using this method in which a portion of the pole is buried in the ground and a remainder extends above-grade. Other poles and similar structures are intended for installation with a lower portion of a pole resting on, and being supported by a separate base, the top of which may be positioned at or above ground level. Metal lamp posts and similar structures are known to be installed on a such a separate base.

Many poles or posts intended for installation on top of a base or support comprise a horizontal square plate or other structure with an arrangement of holes, with one hole typically near each of the four corners of the plate or other structure. This provides fastening holes arranged at the corners of a square so that each hole is equally distant from each of the other two holes adjacent to it. Such a pole is typically installed by securing the plate or other pole-terminating structure with four studs, bolts or fasteners: (a) protruding vertically from the concrete base and up through the plate or other structure or (b) passing down through the holes in the pole base plate or other structure and into the concrete base. Where studs, pins, bolts or the like are positioned to be received in the holes in the pole base plate or other hole-containing structure, the fasteners must be located carefully during preparation of the base or foundation in order to ensure that the fastener spacing matches the locations of the holes in the pole plate or other hole containing structure. Each stud, pin, bolt or the like is usually the upper end of a long rod or is attached to such a rod or other anchor that extends well down into the base or foundation on which the pole is to be installed. If one or more studs protruding from a concrete base are sheered off, as often happens when a motor vehicle collides with a pole mounted on such a concrete base, replacement of the pole may be difficult because of the difficulty of attaching new studs to the concrete base.

SUMMARY

In one embodiment, a pre-fabricated pole base is provided that comprises a main body portion and an upper portion of the main body portion comprises a pole-receiving well. The pole-receiving well comprises a central pole registration hub with a surface for receiving and contacting a pole. The main body portion comprises a plurality of recessed regions operable to receive a fill or ground material and prevent rotation of the pole base. A base section is provided, and at least one of a fastener and a wedge are provided that are operable to align and/or stabilize a pole relative to the pole base.

It is an object of the present disclosure to provide a pole base with a compression connection or attachment method and system of use that is simple to manufacture and install, highly versatile and easy to use. Embodiments of the present disclosure are contemplated for use in a wide variety of configurations and alternative structures using numerous known materials and additional suitable materials and components that may be developed in the future.

In various embodiments, a method of installing a pole base and a lighting pole is provided, the method comprising the steps of: excavating a soil or ground material to create a hole for receiving the precast pole base; providing electrical conduit through the pole base; inserting a pole base into the excavated hole, wherein an embedded lifting anchor is used to attach to and lift the base into a vertical position and lower it into the hole; connecting electrical wiring to existing electrical cables; back-filling the excavated hole around the precast base body; and connecting electrical wiring to the lighting pole; inserting the pole into the recessed pole insertion well; and inserting stabilizing hardware (e.g. wedges, set screws, etc.) to secure the pole in a desired position. Insertion of the pole stabilizing material into the recessed pole insertion well and around the inserted pole is provided to secure the pole in a fixed and stable position.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of these inventions.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1:
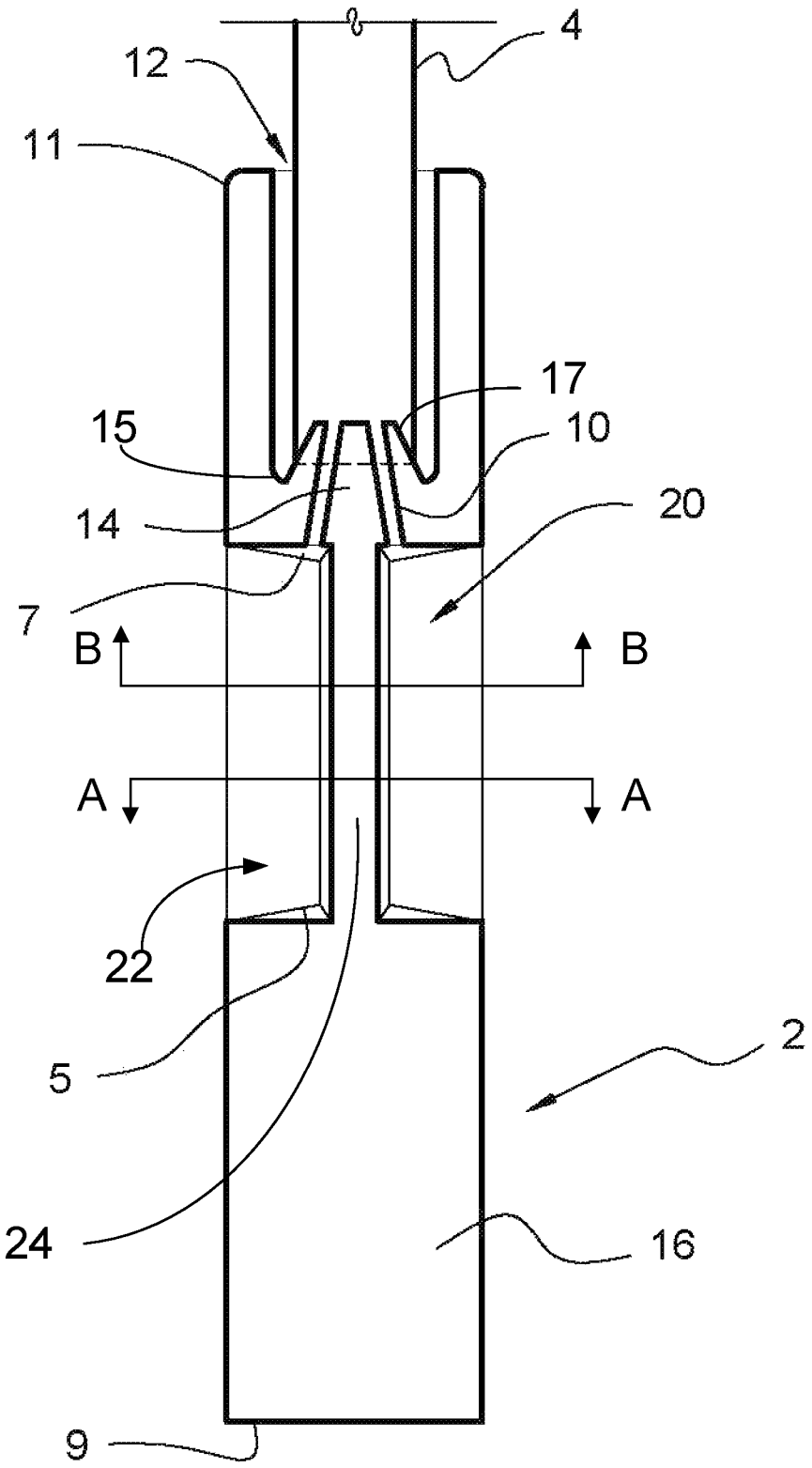
FIG. 1 is a side elevation view of a pole base according to one embodiment of the present disclosure.
Figure 6:
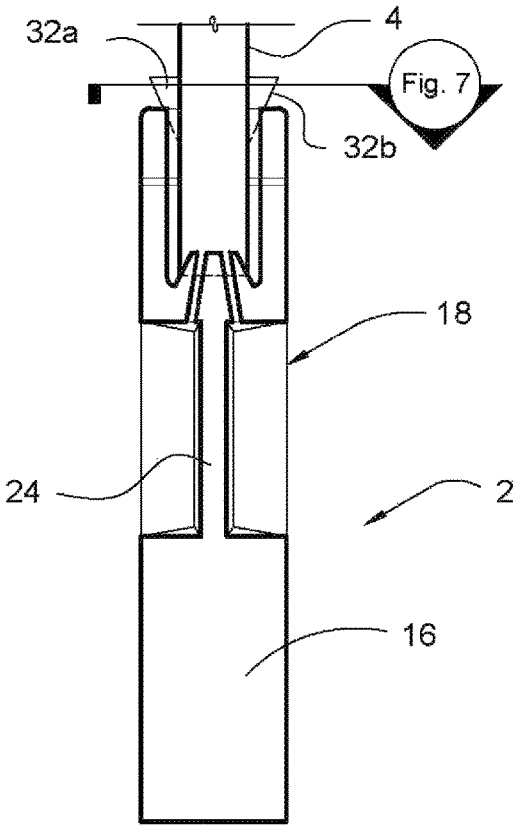
FIG. 6 is a side elevation view of a pole base according to one embodiment of the present disclosure.
Figure 10:
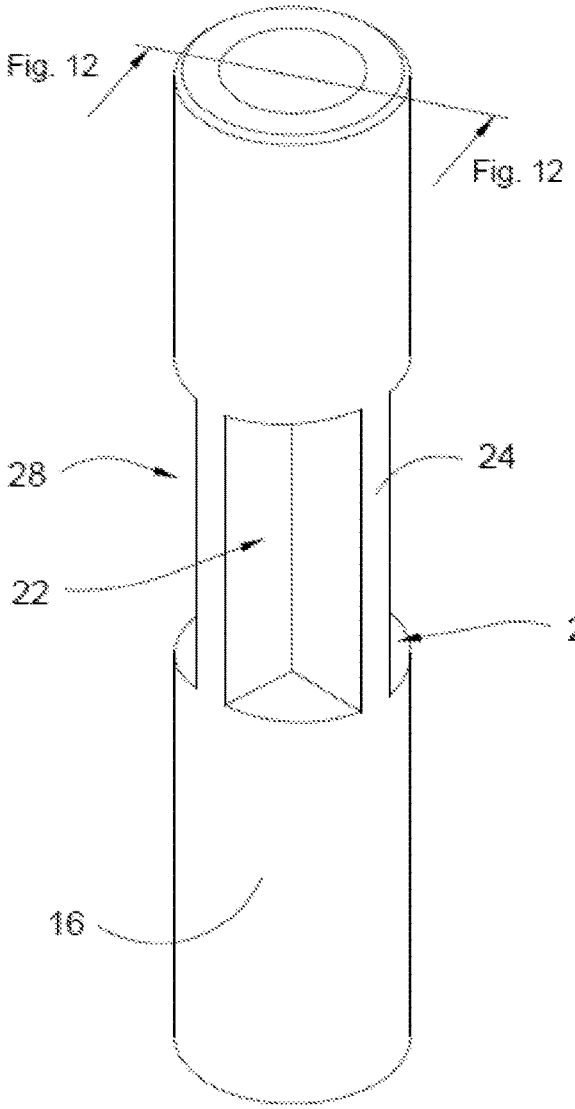
FIG. 10 is a perspective, outer view of the pole base shown in FIG. 1 without a pole inserted into the pole base.
Figure 11:
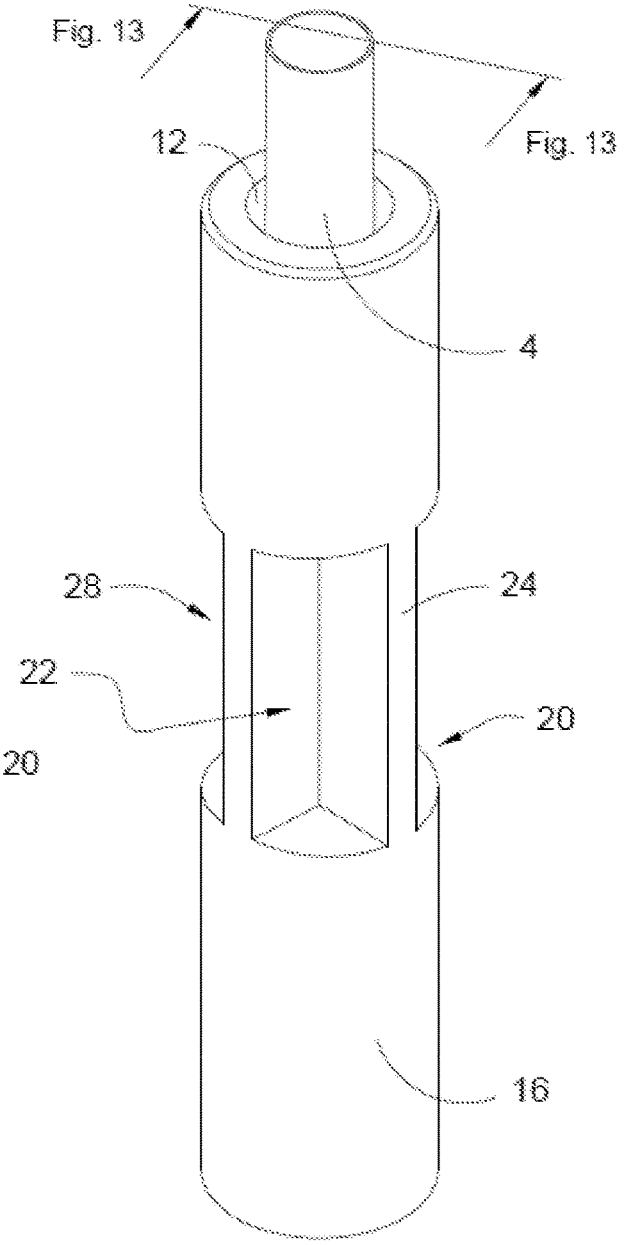
FIG. 11 is a perspective, outer view of the pole base shown in FIG. 1 with a pole inserted into the pole base.
Figure 12:
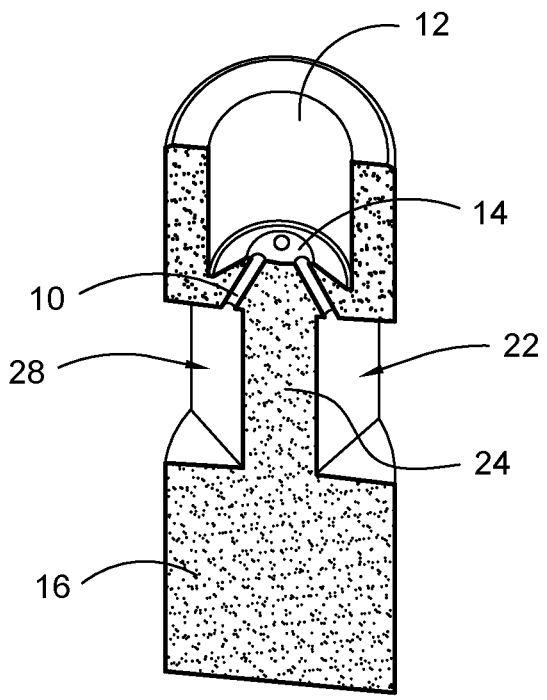
FIG. 12 is a perspective, cross-sectional view of the pole base shown in FIG. 10 cut along the line indicated in FIG. 10.
Figure 13:
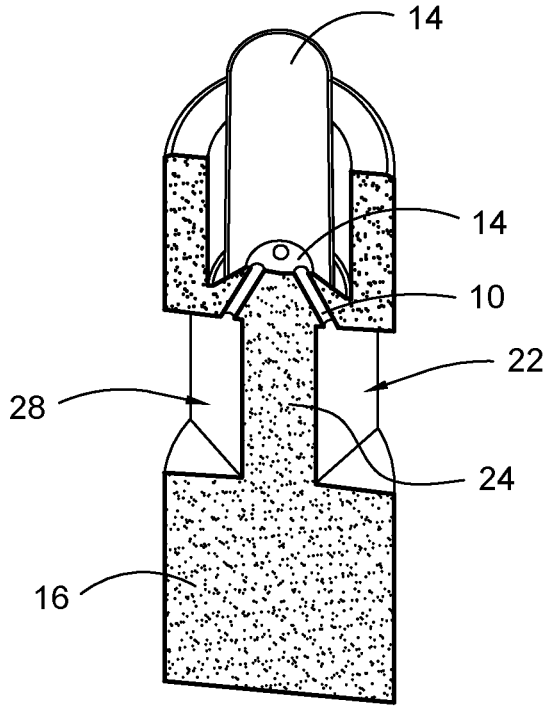
FIG. 13 is a perspective, cross-sectional view of the pole base shown in FIG. 11 cut along the line indicated in FIG. 11.
Figure 14:
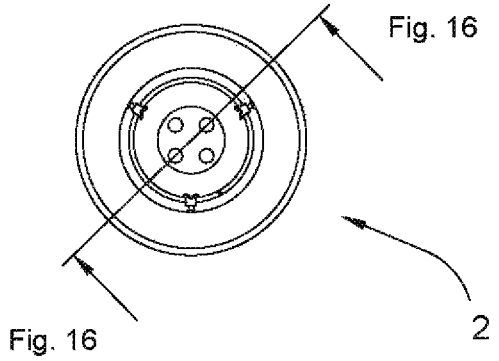
FIG. 14 is a top view of the pole base shown in FIG. 1 without a pole inserted into the well.
Figure 15:
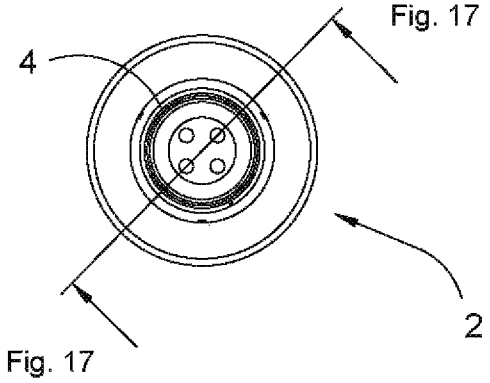
FIG. 15 is a top view of the pole base as shown in FIG. 1
Figure 16:
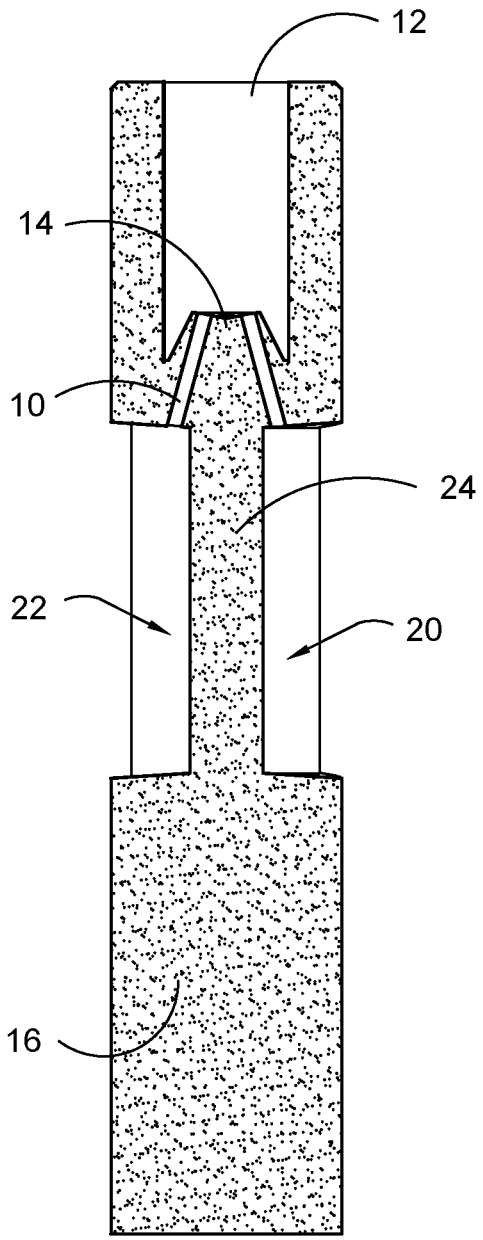
FIG. 16 is a perspective, cross-sectional view of the pole base cut along the line indicated in FIG. 14.
Figure 17:
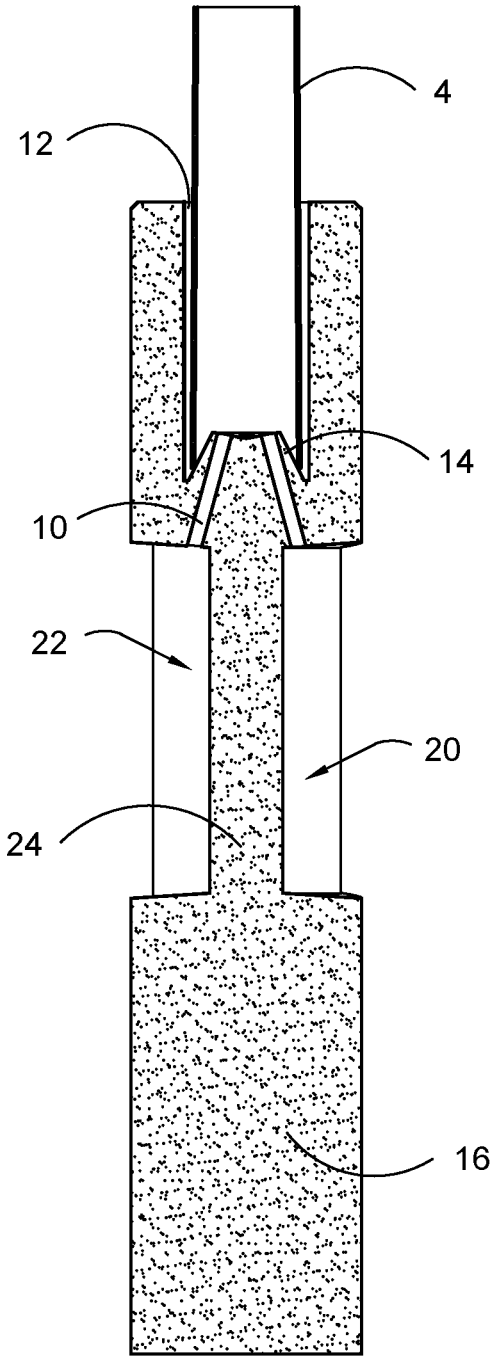
FIG. 17 is a perspective, cross-sectional view of the pole base cut along the line indicated in FIG. 15.

With reference now to FIGS. 1-16, various embodiments and views of the present invention shall now be discussed. Specifically, FIGS. 1, 4 and 6 are diagrammatic, cross-sectional views of a pole base 2 in accordance the present invention. FIGS. 10, 12 and 16 are perspective and cross-sectional views of the same pole base 2 shown in FIG. 1 without a pole 4 inserted into the well 12. FIGS. 11, 13 and 17 are perspective and cross-sectional views of the pole base 2 shown in FIG. 1 with the pole 4 inserted. Further, FIGS. 14 and 15 are top views showing the cut-lines used in FIGS. 16 and 17 respectively.

As shown in FIGS. 1-16, a pole base 2 is provided extending from a top surface 11 to a bottom surface 9. Pole bases of the present disclosure are contemplated as including but not limited to prefabricated concrete pole bases. The exemplary pole base 2 is adapted to accommodate a pole 4 or post. The pole base 2 shown in FIGS. 1-16 may include a depression for receiving a sealant and a sealing gasket. Further, the pole base 2 may preferably further include raceways or conduits 10 for electrical wiring, drainage, etc. A pole insertion well 12 is provided at an upper end of the pole base 2, with a central pole registration hub 14 provided therein. The pole base 2 further includes and is contemplated as receiving a pole stabilizing material (e.g. gravel fill within the insertion well 12). At least one embedded lifting anchor is contemplated as being provided with the pole base 2.

A lower portion of a main concrete form comprises a base portion 16. In some embodiments, the base portion 16 is generally cylindrical in shape and comprises generally circular shaped, planar top and bottom surfaces. In some embodiments, the pole base 2 is provided as having a height approximately four times the diameter.

Figure 2A:
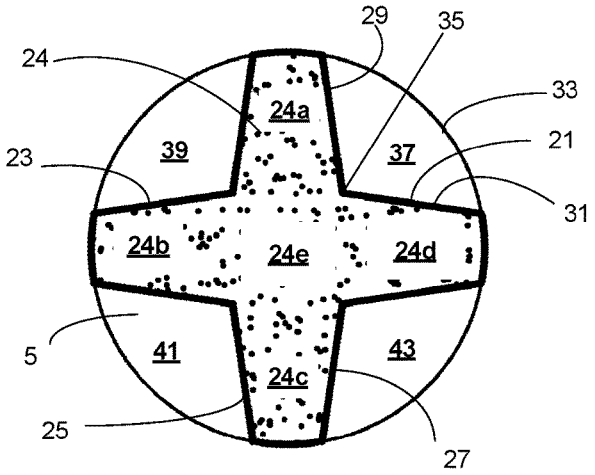
FIG. 2A is a cross-sectional view of the pole base shown in FIG. 1 cut along the line A-A.
Figure 2B:
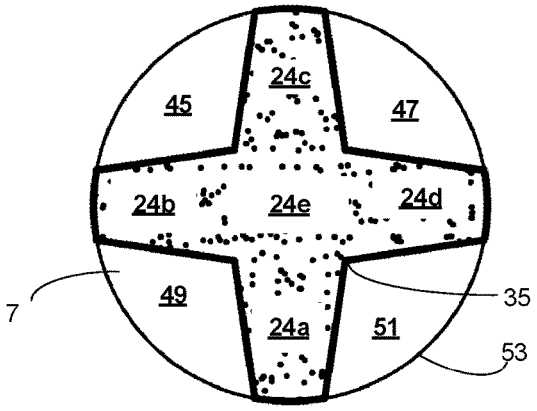
FIG. 2B is a cross-sectional view of the pole base shown in FIG. 1 cut along the line B-B.

As shown in FIG. 1, the central portion 18 of the pole base 2 preferably includes a central support member 24. As shown in FIGS. 2A and 2B, the central support member 24 may preferably include four vertical walls 24*a*, 24*b*, 24*c*, 24*d* extending from a central area 24*e*. Each pair of adjacent vertical walls may preferably intersect to form interior angles 35 and vertically extending surfaces 21, 23, 25 and 27 which delineate vertically extending recessed regions 20, 22, 26, 28. As shown in FIG. 1, the central portion 18 further includes four top surfaces 7 and four lower surfaces 5 as discussed further below.

FIG. 2A is a cross-sectional, top-down view of the pole base shown in FIG. 1 cut along the line A-A. FIG. 2B is a cross-sectional, bottom-up view of the pole base shown in FIG. 1 cut along the line B-B. As shown in FIG. 2A, the lower surfaces 5 form four lower pie or wedge-shaped sections 37, 39, 41, 43. More specifically, the four lower sections 37, 39, 41, 43 are delineated by the internal, vertically extending surfaces 21, 23, 25, 27 of the central support member 24 and the outer perimeter 33 of the base. For example, the internal, vertically extending surface 21 includes two sides (29, 31) which form an interior angle 35 and which extend out to the outer perimeter 33 of the base to define the pie or wedge-shaped lower section 37.

As shown in FIG. 1, each lower section 37, 39, 41, 43 is preferably sloped away from the central support member 24 so that the interior portion of each lower section (e.g., the point of the lower section nearest to its respective interior angle) is elevated above the exterior portion of each lower section (e.g., the points of the lower section nearest the outer perimeter 33).

FIG. 2B illustrates the top surfaces 7 separated by the central support member 24 into four, pie or wedge-shaped top sections 45, 47, 49, 51. As shown in FIG. 1, the top sections 45, 47, 49, 51 are preferably sloped towards the central support member 24 so that the exterior portion of each top section (e.g., the points of each top section nearest the outer perimeter 53 of the base) is elevated above the interior portion of each top section (e.g., the point of each top section nearest to its respective interior angle).

FIG. 2A is a cross-sectional view of the pole base shown in FIG. 1 cut along the line A-A. FIG. 2B is a cross-sectional view of the pole base shown in FIG. 1 cut along the line B-B. As shown in FIG. 2A, the bottom surface 5 is preferably divided by the central support member 24 into four bottom sectors 37, 39, 41, 43. These four bottom sectors are preferably formed as annular sectors defined by each respective vertically extending surface 21, 23, 25 and 27. For example, the vertically extending surface 21 includes two sides (29, 31) which form an interior angle 35 and which define an outer arc length 33 of a single annular sector 37. As shown in FIG. 1, each bottom sector 37, 39, 41, 43 is preferably sloped away from the central support member 24 so that the interior portion of each annular sector (e.g. the point of the annular sector nearest to the interior angle 35) is elevated above the exterior portion of each annular sector (e.g. the point of the annular sector nearest the outer arc length 33). FIG. 2B illustrates the corresponding division of the top surface 7 by the central support member 24 into four top annular sectors 45, 47, 49, 51. As shown in FIG. 1, the top annular sectors 45, 47, 49, 51 are preferably sloped towards the central support member 24 so that the exterior portion of each top annular sector (e.g. the point of each top annular sector nearest its outer arc length 33) is elevated above the interior portion of each top annular sector (e.g. the point of each top annular sector nearest to its interior angle 35).

Figure 3:
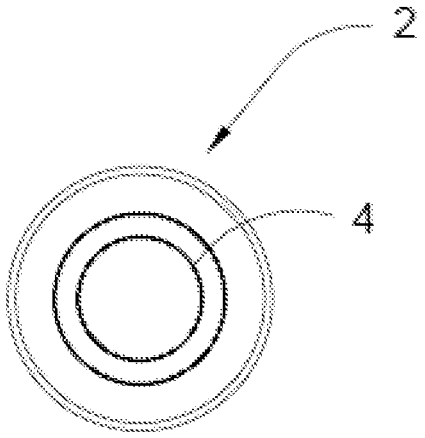
FIG. 3 is a top plan view of the pole base of FIG. 1 with a pole inserted and installed.
Figure 4:
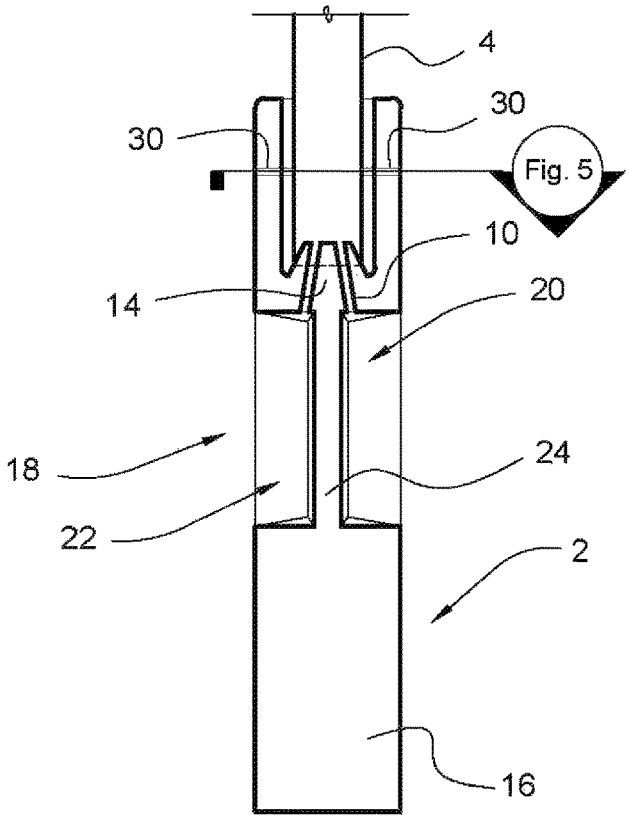
FIG. 4 is a side elevation view of a pole base according to one embodiment of the present disclosure.

FIG. 3 is a top plan view of a pole base 2 and a pole 4 inserted therein. The main precast base body comprises a recessed pole insertion well 12 intended to receive a post 4 or pole. The recessed pole insertion well 12 is represented as a void in the precast base body of the base 2 and is disposed at the top horizontal surface of the base body and further extends downward into the body a distance sufficient to receive the lower most portion of the post 4 or pole. In preferred embodiments, the insertion well 12 extends approximately one-quarter of the overall height of the pole base 2.

With reference to FIGS. 1-3, the recessed pole insertion well 12 is generally cylindrical in shape and comprises a generally vertical wall, and a bottom surface that has an inner bottom surface 17 that is raised from a lower outer bottom surface 15 whereby the inner bottom surface 17 is generally vertical and raised upwards from the generally horizontal outer bottom surface, thereby creating a sloped conical surface forming a central pole registration hub 14. The central pole registration hub comprises, in some embodiments, first, second, third, and fourth round openings 10 for conduit raceways. As shown, the raceways comprising voids that extend from the inner bottom surface 17 of the recessed pole insertion well 12 downward through the precast base body into the recessed regions 22, 24, 26, 28 of the precast base body and comprise a continuous opening. It is contemplated that the recessed pole insertion well 12 may include a tapered vertical wall having a round upper opening which has a greater diameter than the outermost edge of the lower outer bottom surface 15.

The central pole registration hub 14 allows for the ease of positioning a pole 4 centrally within the recessed pole insertion well and for additionally maintaining the pole in said central position throughout an installation process.

In certain embodiments, the central pole registration hub 14 comprises raised anti-flare rings cast into the precast pole base and disposed around the tapered conical surface of the bottom surface of the recessed pole insertion well 12. The rings prevent a pole that is resting on the tapered surface 14 from spreading or flaring outward as would otherwise be encouraged by the tapered conical shape of the central pole registration hub. The anti-flare rings are contemplated as being provided as separate rings sized specifically for an intended pole, and placed into position over the central pole registration hub 14. The anti-flare rings can be made of a variety of materials including but not limited to metals, plastics, polymers, fiberglass, and other similar materials and combinations thereof.

Additionally, the main precast base body comprises first, second, third, and fourth electrical wire chase conduits 10 that run continuous from the top central region of the main precast base body and extend downward at an angle sufficient to move the conduit from the central region of the base body downward and outward, and exiting the base body at the top portion of the recessed anti-rotation region 18 of the base body, thereby creating a continuous opening from the top and out four sides of the main precast base body, through which electrical wiring can be safely transferred and housed.

In some embodiments, pole stabilizing materials (not shown) are provided that comprise a mixture of sand and liquid adhesive that is intended to fill the recessed pole insertion well 12 after the pole 4 has been placed inside the well 12. It is to be understood that the pole stabilizing material can be any fluid, granular or similar material suitable for securing the pole in a fixed, stable, and upright position so that the pole can resist any turning, uplift, or tilting forces exerted on it after installation.

Figure 5:
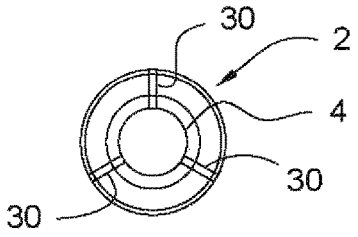
FIG. 5 is a top plan view of the pole base of FIG. 4.

FIGS. 4-5 are front elevation and top plan views of a pole base 2 according to one embodiment of the present disclosure. The pole base 2 comprises various features and structure as shown and described with respect to the embodiment of FIG. 1. As further shown in FIGS. 4-5, the pole base 2 comprises fasteners 30 that are operable to stabilize a pole 4 within a pole base 2. As shown, three fasteners 30 are provided as extending through the sidewall of the pole base 2 and contacting a pole inserted in the pole base. The fasteners 30, which comprise set-screws in some embodiments, are operable to stabilize a pole during and after installation of the pole 4 within the pole base 2. Although three fasteners 30 are shown in FIGS. 4-5 as being spaced radially equidistant from one another, it is contemplated that embodiments of the present disclosure comprise various different numbers and arrangements of fasteners.

Figure 7:
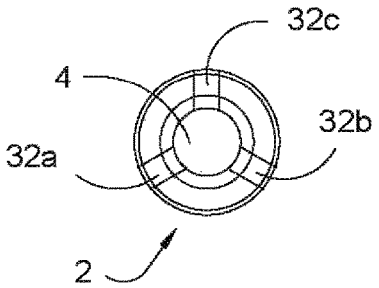
FIG. 7 is a top plan view of the embodiment of FIG. 6.

As shown in FIGS. 6-7, a pole base 2 of one embodiment of the present disclosure comprises a plurality of stabilizing wedges 32*a*, 32*b*, 32*c* having a generally triangular wedge shape with rectangular planar top and bottom surfaces, first and second triangular planar side surfaces, and a rectangular planar back surface, whereby the rectangular planar top and bottom surfaces meet along one edge, with the opposing edge of each rectangular planar top and bottom surface meeting the corresponding opposing edges of the rectangular planar back surface thereby forming a solid wedge shape used to stabilize the pole during the installation process. The wedges 32*a*, 32*b*, 32*c* of FIGS. 6-7 are operable to stabilize a pole 4 during and/or after installation. In some embodiments, it is contemplated that a pole base 2 is provided that comprises a combination of fasteners 30 and wedges 32*a*, 32*b*, 32*c*.

An alternate embodiment of the pole stabilizing hardware for the present disclosure comprises a plurality of threaded rods or set screws that are threaded through the generally horizontal threaded cylindrical holes that penetrate through the precast pole base body from the outermost surface of the precast pole base body through the vertical wall of the recessed pole insertion well where they will forcibly engage the pole. The generally horizontal threaded cylindrical holes are equally spaced around the precast pole base body and generally disposed towards the top of the precast pole base body so as to allow the threaded rods or set screws to fully engage the pole when it is inserted into the recessed pole insertion well.

Figure 8:
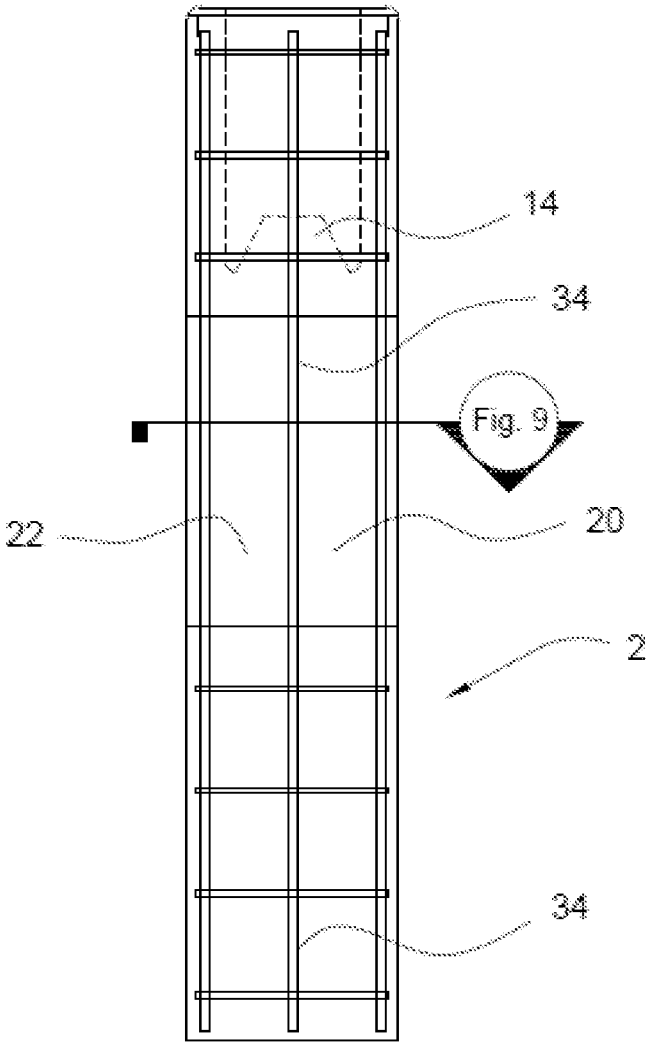
FIG. 8 is a side elevation view of a pole base according to one embodiment of the present disclosure.
Figure 9:
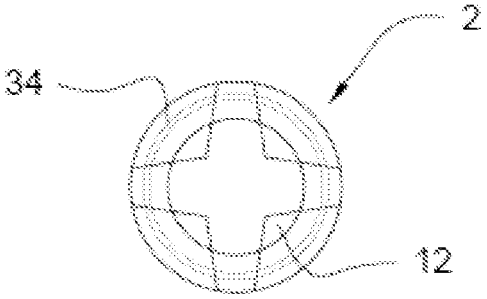
FIG. 9 is a plan view of the embodiment of FIG. 8.

FIGS. 8-9 depict a pole base 2 according to another embodiment of the present disclosure. As shown, the pole base 2 of FIGS. 8-9 comprises various features in accordance with other embodiments described herein. The embodiment of FIGS. 8-9 further comprises a reinforcing member 34 provided within the body of the pole base 2.

The main assembly of interior reinforcing components 34 is inserted into to a form prior to pouring a concrete mixture and serves to reinforce the structural integrity of the main precast concrete base body when the fabrication process is complete. The main assembly of interior reinforcing components 34 may be comprised of one or a multitude of steel reinforcement members, whereby the reinforcing component may be provided as a single reinforcing member or a framework of a plurality of reinforcing members which define an apparatus having a diameter, length, width, and height, that is sufficiently less than the diameter, length, width, and height of the interior volume of the main concrete form in the assembled state, thereby allowing for an amount of concrete to completely surround the entirety of the main assembly of interior reinforcing components.

The main assembly of interior reinforcing components 34 may be constructed of a variety of different suitable materials including but not limited to, metals, polymers, fiberglass, carbon fibers, metal/plastic composites, and other materials not referred to herein which perform the same function as will be recognized by one of ordinary skill in the art. The concrete mixture, which in some embodiments comprises of a high-grade concrete mixture, is then created and poured into the main concrete form, surrounding the entirety of the main interior reinforcing component.

In some embodiments, at least one lifting anchor is embedded into the main concrete form of a pole base 2. The lifting anchor is disposed at a center of the horizontal inside upper bottom surface of the recessed pole insertion well so as to allow ease of lifting the base into a vertical position for lowering into the excavated hole. Alternate positioning of the lifting anchor is on the bottom surface of the main precast base body, inward a distance from the outer edges of the main precast base body, and thereby allow a substantial portion of the anchor body to be embedded into the volume of the form to be filled with concrete. The lifting anchor may vary in type and size while still performing the intended purpose and function.

Once the concrete is cured or hardened, the main precast base body is removed from the form and optionally finished by a variety of methods including but not limited to, texturing, staining, etching, polishing, glazing, sealing, color coating, and other finish methods not referred to herein.

It is to be understood that embodiments of the present disclosure are intended to be manufactured using concrete which may be represented in a variety of types and composition mixes having various combinations of ingredients such as cement, water, cementitious materials, and chemical and or mineral admixtures, coloring agents, which when combined will create a concrete material.

It is to be further understood that embodiments of the present disclosure are contemplated as being manufactured in a variety of shapes other than cylindrical, including but not limited to, square, rectangular, triangular, or elliptical, as viewed from the top, as well as other shapes whether or not referred to herein.

Embodiments of the present disclosure are intended to be used for such applications including but not limited to, as a mounting and stabilizing support for light poles, sign posts, sign panels, traffic light poles, flag poles, radar equipment mounting poles, communication equipment mounting poles, solar panel array mounting poles, wind turbine poles, or other applications for mounting, support and stabilization not referred to herein. The soil used to backfill a hole within which the pole base of the present invention is positioned can be any fluid, granular, or similar material suitable for securing the pole base in a stable, upright position so that the base can resist any turning, uplift, or tilting forces exerted on the base or a pole attached to it. Accordingly, "soil" includes earth, dirt, stone, or other aggregate, concrete and any other suitable material. Holes within which the pole base of this invention are positioned can be excavated in undisturbed earth (including loose soil, stone, rock and other materials), in fill, in other naturally occurring or human-made structures like parking lots.

While various embodiments of the disclosed device have been described in detail, it is apparent that modifications and alterations of those embodiments will occur to those skilled in the art. However, it is to be expressly understood that such modifications and alterations are within the scope and spirit of the present disclosure, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

The foregoing discussion has been presented for purposes of illustration and description. The foregoing is not intended to limit the disclosure to the form or forms disclosed herein. In the foregoing description for example, various features of the disclosure have been identified. It should be appreciated that these features may be combined together into a single embodiment or in various other combinations as appropriate. The dimensions of the component pieces may also vary, yet still be within the scope of the disclosure. Moreover, though the description has included description of one or more embodiments and certain variations and modifications, other variations and modifications are within the scope of the disclosure, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The present disclosure, in various embodiments, includes components, methods, processes, systems and/or apparatus substantially as depicted and described herein, including various embodiments, subcombinations, and subsets thereof. Those of skill in the art will understand how to make and use the devices of the disclosure after understanding the present disclosure. The present disclosure, in various embodiments, includes providing devices and processes in the absence of items not depicted and/or described herein or in various embodiments hereof including in the absence of such items as may have been used in previous devices or processes, e.g., for improving performance, achieving ease and/or reducing cost of implementation. Rather, as the following claims reflect, inventive aspects lie in less than all features of any single foregoing disclosed embodiment.

What is claimed is:

1. A pre-fabricated pole base having an interior, a top surface and a bottom surface, the pole base comprising:

a pole-receiving well, wherein the pole-receiving well is open at the top surface and extends into the interior of the pole base;

wherein the pole-receiving well comprises a hollow interior, an inner bottom floor surface and an outer bottom floor surface; wherein the inner bottom floor surface comprises a central pole registration hub; wherein the central pole registration hub extends above the outer bottom floor surface; wherein the central pole registration hub is configured to insert within an interior of an inserted pole;

a central support structure, wherein the central support structure comprises four upper surfaces, a central support member and four lower surfaces; wherein the central support member comprises a cruciform column comprised of four walls extending from a central area; wherein the upper surfaces form four upper pie or wedge-shaped sections separated by each of the four walls respectively; wherein each of the upper sections slope towards the central support member such that an exterior portion of each of the upper sections is elevated above an interior portion of the respective upper section; wherein the lower surfaces form four lower pie or wedge-shaped sections separated by each of the four walls respectively; wherein each of the lower sections slope away from the central support member such that an interior portion of each of the lower sections is elevated above an exterior portion of the respective lower section; wherein the upper sections, the lower sections and the walls of the central support structure together define four recesses in the central support structure;

a conduit, wherein the conduit extends through the central pole registration hub; wherein the conduit is positioned to extend within the interior of the inserted pole in contact with the central pole registration hub; wherein the conduit is positioned to connect the interior of the inserted pole with one of the four recesses; and a base member, wherein the base member is located underneath the central support structure.

2. The pole base of claim 1, wherein the pole base further comprises at least one stabilizing wedge; wherein the stabilizing wedge comprises a triangular wedge shape.

3. The pole base of claim 2, wherein the pole base further comprises an embedded reinforcement member, wherein the embedded reinforcement member comprises a wireframe grid.

* * * * *